US006172338B1

(12) United States Patent
Barnes et al.

(10) Patent No.: US 6,172,338 B1
(45) Date of Patent: Jan. 9, 2001

(54) COOLING SYSTEM FOR A COOKING APPLIANCE

(75) Inventors: Shelton T. Barnes, Chattanooga; Perry A. Bennett; Norman T. McGuffey, both of Cleveland, all of TN (US)

(73) Assignee: Maytag Corporation, Newton, IA (US)

( * ) Notice: Under 35 U.S.C. 154(b), the term of this patent shall be extended for 0 days.

(21) Appl. No.: 09/412,433

(22) Filed: Oct. 5, 1999

(51) Int. Cl.[7] ..... A21B 3/00; F27D 1/12

(52) U.S. Cl. ..... 219/399; 219/400; 126/21 R

(58) Field of Search ..... 219/399, 400, 219/408; 126/15 R, 19 R, 21 A, 21 R, 193, 198; 99/401

(56) References Cited

U.S. PATENT DOCUMENTS

| | | | | |
|---|---|---|---|---|
| 2,525,614 | | 10/1950 | Nelson et al. . | |
| 3,310,046 | * | 3/1967 | Scott et al. | 126/21 A |
| 3,499,430 | * | 3/1970 | Kemp | 126/21 R |
| 3,548,152 | * | 12/1970 | Klepzig | 219/400 |
| 3,612,825 | | 10/1971 | Chase et al. . | |
| 3,633,561 | * | 1/1972 | Barnett et al. | 126/21 R |
| 3,659,578 | * | 5/1972 | Davis et al. | 126/21 R |
| 3,692,015 | | 9/1972 | Chase et al. . | |
| 3,962,561 | * | 6/1976 | Maitenaz | 126/19 R |
| 4,241,718 | | 12/1980 | Barnett . | |
| 4,253,286 | | 3/1981 | Katona . | |
| 4,354,084 | * | 10/1982 | Husslein et al. | 126/21 A |
| 4,390,767 | | 6/1983 | Bucksbaum et al. . | |
| 4,716,884 | | 1/1988 | Bonaccorsi et al. . | |
| 4,763,638 | * | 8/1988 | Hurley et al. | 126/21 A |
| 4,865,010 | | 9/1989 | Kett . | |
| 5,107,821 | | 4/1992 | Von Blanquet . | |
| 5,193,520 | | 3/1993 | Gostelow et al. . | |
| 5,379,685 | * | 1/1995 | Krasznai | 126/21 R |
| 5,441,036 | | 8/1995 | Mikalauskas, II et al. . | |
| 5,801,362 | * | 9/1998 | Pearlman et al. | 219/400 |
| 5,874,714 | * | 2/1999 | Sik | 126/21 A |

* cited by examiner

*Primary Examiner*—Joseph Pelham
(74) *Attorney, Agent, or Firm*—Everett G. Diederiks, Jr.

(57) ABSTRACT

A cooking appliance includes a cabinet, defined by at least front, side, bottom and rear panel portions, and at least one oven cavity positioned therein. When placed in an in-use position, the bottom panel portion is spaced from a supporting surface, preferably by multiple, vertically adjustable leg members, such that an air passageway is defined below the bottom panel. At least one opening is formed at a lower rear section of the appliance to allow air to flow into a passageway defined in the cabinet between the oven cavity and the rear panel portion of the cabinet. At least one outlet opening is formed in an upper portion of the cabinet to allow the cooling air to exit the cabinet. With this arrangement, operation of the cooking appliance causes air to be drawn along the bottom of the appliance, into the cabinet, upward within the passageway and then out of the cabinet.

25 Claims, 4 Drawing Sheets

COOLING SYSTEM FOR A COOKING APPLIANCE

BACKGROUND OF THE INVENTION

1. Field of the Invention

The present invention pertains to the art of cooking appliances and, more particularly, to a system for cooling portions of a cooking appliance, preferably utilizing natural, unforced convection to provide a flow of air used to keep certain portions of the cooking appliance at appropriate temperatures in order to protect control and/or wiring components of the appliance from overheating.

2. Discussion of the Prior Art

In general, it is fairly common to provide a system to cool a domestic oven or the like so that the exterior of the oven is safe to touch during operation of the oven and to further protect various control components and instruments from extreme heat. This condition can be particularly important in pyrolytic self-cleaning ovens. Such ovens are designed to reach rather extreme temperatures, such as in the order of 400° C., in order to effect proper cleaning by incineration of grease and other food stuff which normally accumulates on the oven walls through routine use. Even at lower operating temperatures, the back and sides of the oven may be close to certain wiring, other appliances, cabinetry, etc. such that protecting these other elements is desired.

Prior art ovens have often relied upon forced air cooling systems for controlling the exterior temperatures. Such forced air cooling systems have also been used to protect the various instruments and controllers present in a typical domestic oven from extreme heat. However, all such forced air cooling systems have particular cost and reliability concerns. Specifically, the fan, its motor and associated controls add to the expense of the overall appliance and, often times, represent another reliability concern. To avoid the problems of using a forced air cooling system in an oven, U.S. Pat. No. 4,241,718 proposes to use a convection cooling system in a pryolytic self-cleaning type range. While the '718 patent does address the main problems associated with using a cooling fan in an oven by eliminating the fan altogether and using a convection driven air cooling system, the patented arrangement is only designed to cool the front and top of an oven. Therefore, no provision is made within the patent for cooling the bottom or back of the range unit. Often, several electrical components are located on the back of an oven, such as, for example, the connection for the electrical power cord etc.

Actually, one regulated design parameter for an electrical cooking appliance concerns assuring that the wiring of the appliance is well protected from exposure to extreme temperatures. In a domestic range, the oven cavity is typically spaced from a supporting surface by a lower storage drawer. This vertical spacing provides a significant amount of area in the lower back portion of the appliance for attachment of wiring for the appliance. More specifically, the internal wiring for baking and broiling elements of the range is capable of being exposed to rather high temperatures, but the plug-in cord for the range needs to be connected to the range in a zone which is maintained relatively cool.

There has now been introduced into the market a range incorporating upper and lower ovens. While such a range provides certain versatility advantages over a conventional range having only a single oven cavity, the dual oven arrangement means that room for the lower drawer is no longer present and the connection zone for the plug-in cord is arranged adjacent at least one oven cavity so as to be, at least potentially, exposed to higher temperatures.

Based on the above, there exists a need in the art of cooking appliances for a cooling system which can cool certain portions of an appliance by providing for a flow of air across or adjacent these portions. In addition, there exists a need for a cooling system for a cooking appliance which relies on natural convection of cooling air in order to avoid the need for any type of forced air system.

SUMMARY OF THE INVENTION

In accordance with the present invention, a cooking appliance includes a cabinet and at least one oven cavity, with the cabinet being generally defined by front, bottom, top, side wall and back panel portions. The cabinet carries various leg members used to lift the cabinet away from a supporting surface, such as a floor in a kitchen, so as to define a gap extending beneath the appliance. With this arrangement, air is permitted to flow, beneath the appliance, from the front of the appliance towards its back.

Within the cabinet, a main back panel is provided, with the main back panel being arranged between a rear wall of the oven cavity and the back cabinet panel. The air flowing beneath the appliance is directed into a cooling space between the oven cavity and the main back panel. In accordance with a preferred embodiment, the back panel terminates short of the main back panel and a first set of louvers is provided in the main back panel at a relatively low position to enable the air to flow into the cooling space. A second set of louvers is provided at a relatively high location in the main back panel. With this arrangement, a flow of cooling air is directed beneath the appliance, into a lower section of the cooling space, through the first set of louvers, upward within the cooling space generally adjacent the rear wall of the oven cavity, and into a zone between the main back panel and the back cabinet panel, either through the second set of louvers or additional openings provided in the main back panel. Numerous outlets are formed in the back panel, preferably at various levels, to allow the flowing air to escape.

In the most preferred form of the invention, the cooking appliance takes the form of a range having upper and lower oven cavities. Therefore, the cooling system of the invention can be used to cool surfaces generally adjacent to either or both of the oven cavities. One particular advantage of this overall arrangement is that a power cord attachment zone, located at a relatively lower section of the main back panel, will remain below a temperature which could cause damage to the sheathing or wires of the power cord.

Additional objects, features and advantages of the present invention will become more fully apparent from the following detailed description of a preferred embodiment, when taken in conjunction with the drawings wherein like reference numerals refer to corresponding parts in several views.

DETAILED DESCRIPTION OF THE PREFERRED EMBODIMENT

Figure 1:
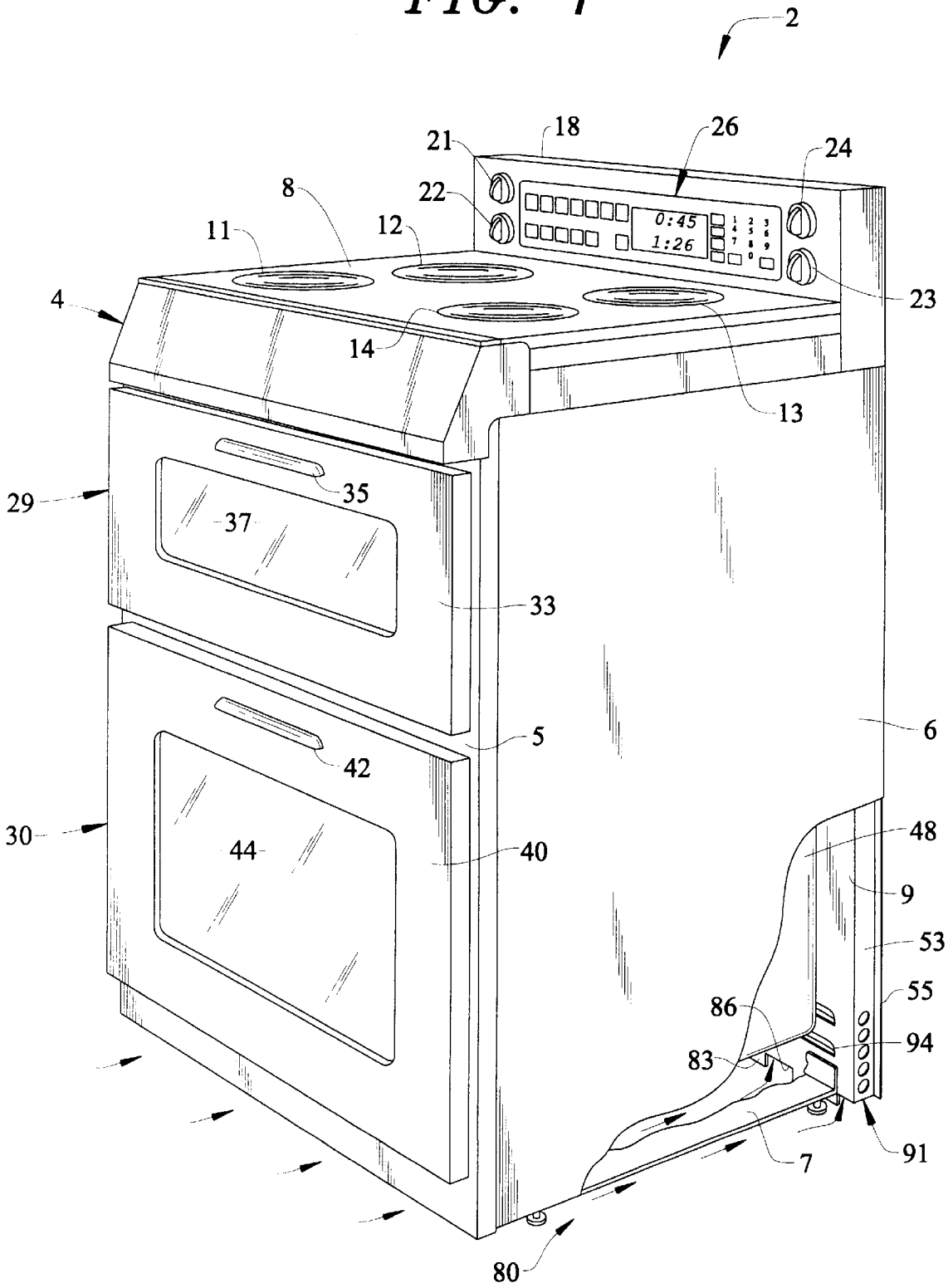
FIG. 1 is an upper right front perspective view of a cooking appliance incorporating the cooling system configured in accordance with a preferred embodiment of the present invention.

With initial reference to FIG. 1, the cooling system of the present invention is preferably incorporated into an electric range generally indicated at 2. Range 2 includes a cabinet 4 having a front panel portion 5, side panel portions 6, a bottom panel portion 7 which is shown broken away in this figure, a range top 8 and a main back panel 9. Range top 8 can take various forms in a manner known in the art. In the embodiment shown, range top 8 incorporates various surface heating elements 11–14. Cabinet 5 further includes a rear, upstanding control panel 18. Control panel 18 supports a plurality of knobs 21–24 for controlling the activation/deactivation of surface heating elements 11–14 respectively. Furthermore, control panel 18 is shown to include a central control and display unit, generally indicated at 26, for use in controlling upper and lower ovens 29 and 30 respectively.

At this point, it should be noted that the most preferred form of the invention does include both upper oven 29 and lower oven 30. However, it also should be understood that the cooling system of the invention is also applicable to more conventional ranges having a single, large upper oven and a storage drawer or the like therebelow. In any event, in the embodiment shown, upper oven 29 has associated therewith a door 33 which can be pivoted by means of a handle 35. Door 33 preferably includes a window 37 for viewing the interior of oven 29. In a similar manner, lower oven 30 has associated therewith a door 40, a handle 42 and a window 44. In a manner known in the art, ovens 29 and 30 define oven cavities 46 and 48 (see FIG. 4) respectively.

Figure 2:
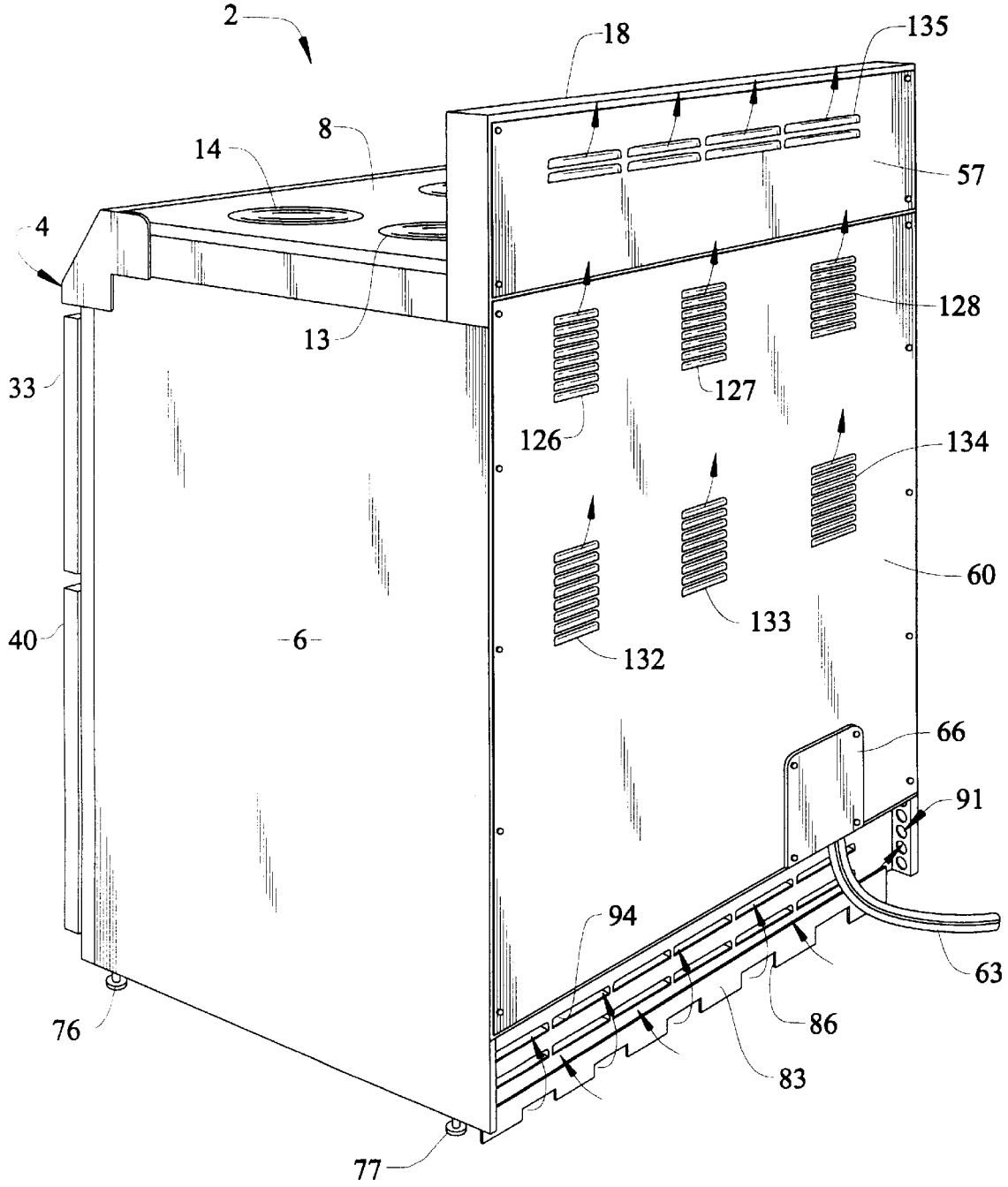
FIG. 2 is generally a rear perspective view of the cooking appliance of FIG. 1.

Main back panel 9 is attached to bottom panel 7 and is bent at the sides thereof to define wall portions such as that shown at 53 in FIG. 1. Each wall portion 53 terminates in a rear, elongated flange 55. Preferably, each side panel 6 wraps around and is secured to main back panel 9 with mechanical fasteners extending through elongated flange 55. As best shown in FIG. 2, the back of range 2 is generally closed off by means of an upper panel 57 that is secured to control panel 18 and a back panel or cover 60 that is also attached to main back panel 9, preferably at elongated flanges 55 with side panels 6. As also illustrated in this figure, as well as FIG. 4, back cover 60 preferably extends vertically a distance shorter than main back panel 9 such that a portion of main back panel 9 is exposed at a rear of range 2. Extending from behind back cover 60 is an electric power cord 63. More specifically, power cord 63 extends behind a plate 66 secured to back cover 60.

Range 2 is adapted to be mounted upon a supporting surface, such as a kitchen floor or the like. More specifically, a plurality of leg members, two of which are indicated in FIGS. 1 and 2 at 76 and 77, extend from bottom panel 7 at front and rear portions of cabinet 4 along side panel 6. Of course, corresponding leg members are also provided on the opposing side of range 2. In any event, the various leg members 76 and 77 are preferably vertically adjustable to also act as levelers for range 2. Such type of leg leveler arrangements are widely known in the art of appliances, including ranges and refrigerators such that this function of leg members 76 and 77 does not form part of the present invention. However, in accordance with the present invention, it is important to note that leg members 76 and 77 maintain range 2 at a position spaced above the supporting surface such that a first passageway 80 is defined beneath bottom panel 7 of cabinet 4. This arrangement is perhaps best illustrated in FIGS. 1 and 4.

As will be detailed more fully below, the spacing of bottom panel 7 above the supporting surface for range 2 permits air to flow within first passageway 80, generally from front panel portion 5 to the rear of cabinet 4. As shown, main back panel 9 has attached thereto an extension member 83 that extends below bottom panel 7 and which is formed with various laterally spaced slots 86. In the most preferred form of the invention, cabinet 4 is generally formed from sheet metal components in a manner generally known in the art. However, since extension member 83 may engage the supporting surface upon which range 2 is placed, extension member 83 is preferably made of a more flexible material. In the most preferred form of the invention, paperboard is utilized for extension member 83. However, even more elastic materials, such as rubber or plastic, could be utilized.

Due to the presence of slots 86, air flowing towards main back panel 9 through first passageway 80 can flow past main back panel 9. This is perhaps best illustrated in FIG. 2 of the drawings. At this point, the following air can change direction and, in accordance with the present invention, is able to enter cabinet 4. More specifically, the most preferred form of the invention incorporates a plurality of vertically spaced holes 91 formed at a lower portion of each wall portion 53 of main back panel 9 such that the air will enter an area between main back panel 9 and side panel 6. Furthermore, a lower rear portion of cabinet 4, specifically along the lower portion of main back panel 9, is formed with a first set of inlet openings 94 as clearly shown in each of FIGS. 1–4. Inlet openings 94 preferably take the form of louvers which are stamped out of main back panel 9 and lead to an internal, second passageway 97 (see FIG. 4).

Figure 4:
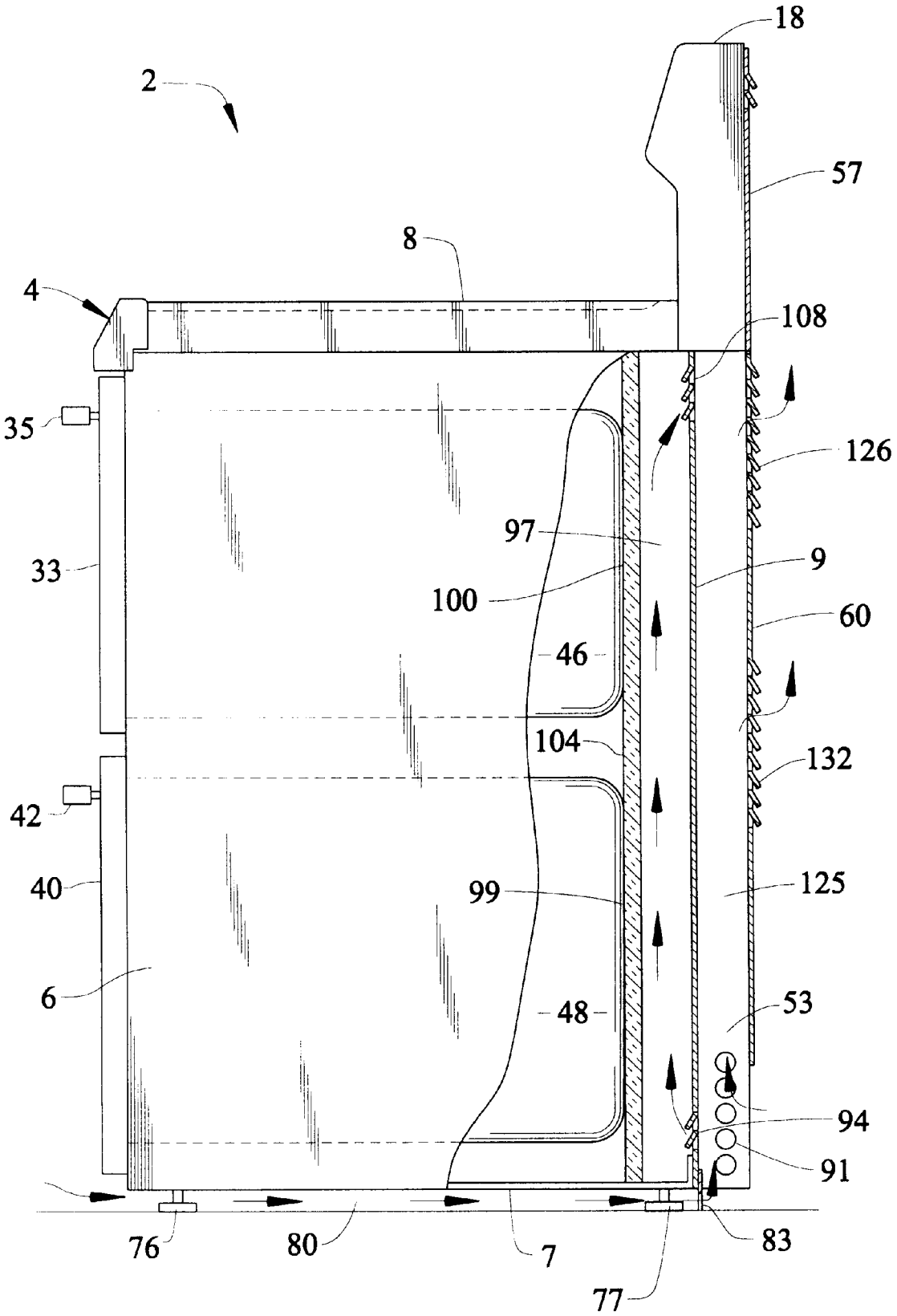
FIG. 4 is a partial, cross-sectional side view of the cooking appliance.

As best shown in FIG. 4, second passageway 97 is generally defined between main back panel 9 and rear walls 99 and 100 of upper and lower oven cavities 46 and 48 respectively. As shown in this figure, a vertically arranged layer of insulation 104 is positioned against rear walls 99 and 100. Actually, although not shown for the sake of simplicity of the drawings, upper and lower oven cavities 46 and 48 are actually well wrapped in insulation both individually and with common wrap pieces. Regardless of the presence of the insulation, the temperatures that can be generated within oven cavities 46 and 48 have the potential for creating fairly high temperatures at main back panel 9. Although the cooling system of the present invention provides advantageous cooling for numerous surfaces associated with range 2, a particular function of the system is to control the temperature of main back panel 9. Particularly, it is desired to maintain a lower portion of main back panel 9 relatively cool for the reasons which will become more fully evident below.

Figure 3:
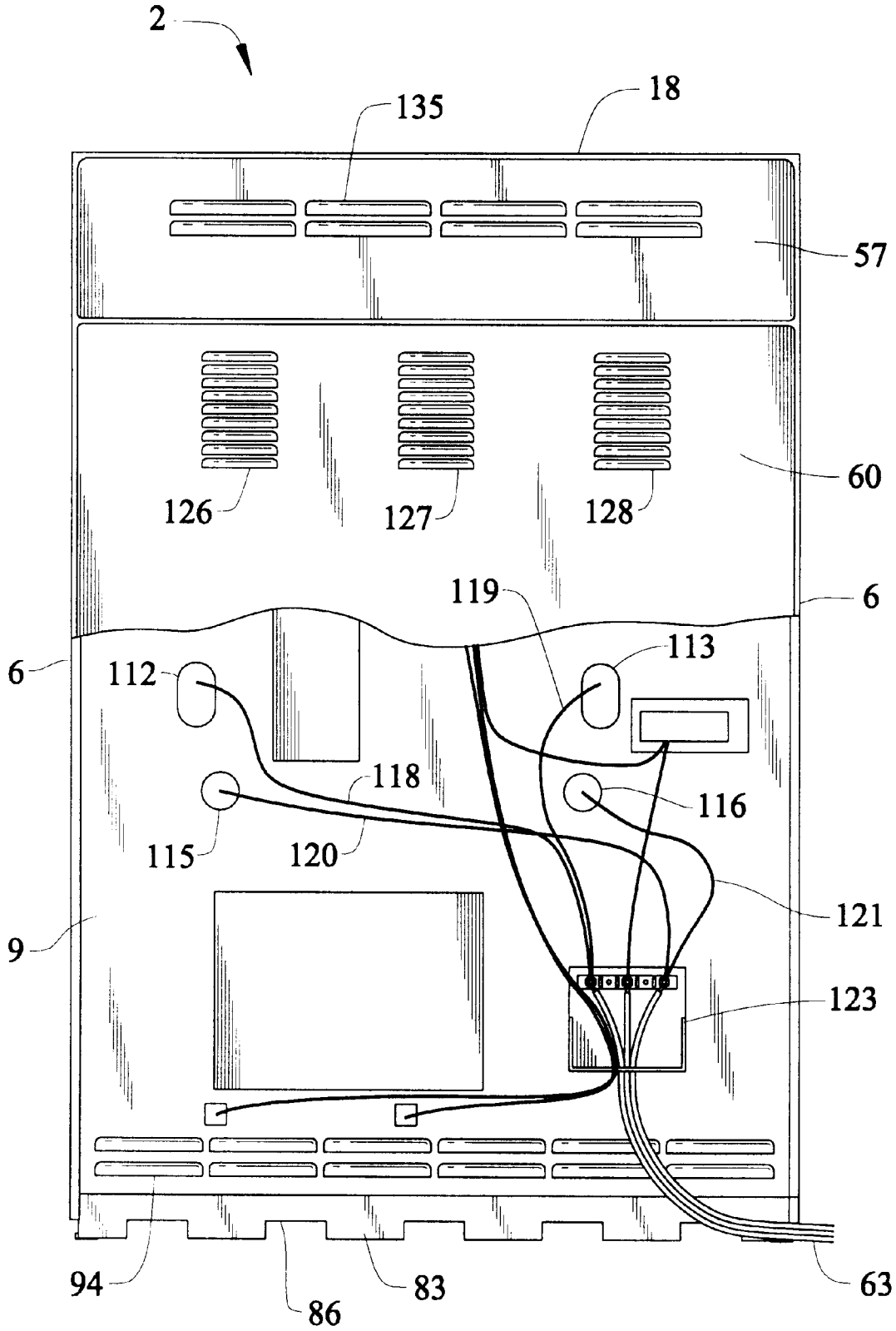
FIG. 3 shows a rear, elevational view of the cooking appliance of FIGS. 1 and 2.

As clearly shown in FIG. 4, air entering second passageway 97 is permitted to flow upward behind oven cavities 46 and 48 and exit through an upper set of openings 108. Again, the preferred embodiment of the invention has openings 108 defined by louvers, although various other opening arrangements could be equally utilized. In addition to through openings 108, there are various additional holes or openings formed in main back panel 9 through which the flow of cooling air can exit second passageway 97. FIG. 3 illustrates various openings provided in accordance with the preferred embodiment of the invention. More specifically, a first intermediate set of openings 112 and 113 is provided. Openings 112 and 113 actually define apertures through which electrical connection members for a lower bake element arranged in upper cavity 46 can extend. A second intermediate set of openings 115 and 116 is also provided to enable electric connection members for another electrical heating element, which preferably defines the broiler element in lower oven cavity 48, to project through main back panel 9. Although the heating elements are not shown for the sake of simplicity, wires 118–121 associated with the heating elements are illustrated. As is known in the art, these types of wires are quite resistant to high temperatures, as opposed to power cord 63. In any case, wires 118–121 lead to a connector block or plate 123 to which power cord 63 is also joined. Various additional wires (not separately labeled) also extend to connector plate 123 from temperature sensors and, particularly, control panel 18. As the manner in which the various electrical heating elements for oven cavities 46 and 48 are controlled is not considered part of the present invention and is widely known in the art, it will not be discussed further herein.

Regardless of whether the air flowing within second passageway 97 goes through upper openings 108 or intermediate openings 112, 113, 115 or 116, the air flow reaches a third passageway 125 defined by a space between main back panel 9 and back cover 60. Back cover 60 is provided with various laterally spaced, upper sets of outlet openings generally indicated at 126–128 in FIGS. 2 and 3. FIG. 2 also indicates various intermediate sets of outlet openings 132–134. Additional outlet openings 135 are provided for venting purposes in the back of control panel 18.

As indicated above, wires 188–121 are of a type known in the art which can withstand rather high temperatures and therefore would not become damaged by heat radiating from insulated oven cavities 46 and/or 48. However, power cord 63, which is generally of the type having aluminum or copper wires sheathed in rubber, could become damaged if exposed to high temperatures. Therefore, it is important that the area in which connector plate 123 is located be maintained relatively cool and that the remainder of power cord 63 not be subjected to extreme temperatures. Although cooling problems can be a concern in a conventional range having a single oven cavity, the potential for higher temperatures at connector plate 123 is exacerbated given the presence of lower oven cavity 48 in accordance with the preferred construction of range 2. However, it has been found that the cooling system of the present invention more than adequately maintains main back panel 9 at a suitable temperature, particularly in the area of connector plate 123.

In the most preferred form of the invention, the cooling system does not utilize a forced air flow system, although a blower fan or vacuum fan could be utilized if desired. Instead, it is most preferred to simply develop a flow of cooling air through natural convection based on the operation of either or both of ovens 29 and 30. More specifically, when either of ovens 29 or 30 is activated, the air within second passageway 97 will become heated and will tend to rise. This will create a slight vacuum, causing air to be drawn into second passageway 97. More specifically, air will be caused to flow from adjacent front panel portion 5, beneath bottom panel 7, and towards main back panel 9. Adjacent main back panel 9, the cooling air will flow through slots 86 of extension member 83 and a substantial percentage of the cooling air will enter second passageway 97 through either the vertically spaced holes 91 or the first set of inlet openings 94. Given the position of passageway 97, heat will be drawn away from main back panel 9 and the heated air will continue to rise within second passageway 97 until it enters third passageway 125, either through the upper openings 108 or the intermediate openings 112, 113, 115 or 116. Thereafter, the flowing air will exit cabinet 4, such as through the upper set of outlet openings 126–128 or intermediate outlet openings 132–134.

Since connector plate 123 is attached at a relatively low position on main back panel 9, the temperature of the cooling air within second passageway 97 at the vertical level of connector plate 123 will only be slightly higher than the ambient temperature. Therefore, a substantial amount of the heat, which could possibly be transferred to main back panel 9 at this location, will be taken away by the flow of cooling air. As a result, connector plate 123 is maintained relatively cool such that the cooling system of the present invention advantageously avoids damage to power cord 63. Of course, at the same time, the cooling system protects the supporting surface for range 2 as the cooling air is directed across the bottom of cabinet 4. Furthermore, by simply providing a flow of cooling air, surrounding appliances or cabinetry will not be subjected to substantial temperatures.

In accordance with the invention, in addition to allowing air to flow therethrough by means of slots 86, extension member 83 also advantageously prevents power cord 63 from being inadvertently positioned beneath cabinet 4. That is, even if range 2 was slid against a rear wall during installation, the presence of extension member 83 prevents power cord 63 from becoming undesirably lodged beneath cabinet 4 where it would be subjected to somewhat higher temperatures along bottom panel 7, mainly due to the position of lower oven cavity 48.

Although described with reference to a preferred embodiment of the invention, it should be recognized that various changes and/or modifications could be made without departing from the invention. For instance, as mentioned above, the particular construction and arrangement of the openings which fluidly connect the various passageways could be readily altered without departing from the spirit of the invention. In addition, although the invention has been shown for use in combination with an electric range, the principles of the present cooling system could be equally applicable to other types of cooking appliances, including gas ranges. Furthermore, provisions could be made for additional flow passages, such as below range top 8 from the front to the rear of cabinet 4. In any event, the invention is only intended to be limited by the scope of the following claims.

We claim:

1. A cooking appliance comprising:

a cabinet including at least a front portion, opposing side panels, a bottom panel and a back panel, said cabinet being adapted to rest upon a supporting surface with the bottom panel being spaced above the supporting surface so as to define a first passageway beneath the cabinet;

at least one oven cavity positioned within the cabinet, said oven cavity including a rear wall spaced from the back panel such that a second passageway, which is open to the first passageway, extends upward between the rear wall of the oven cavity and the back panel;

a main back panel extending between the side panels at a position located between the rear wall of the oven cavity and the back panel; and at least one exit opening formed in an upper portion of the back panel, wherein cooling air is caused to flow, during operation of the cooking appliance, from the front portion toward the back panel through the first passageway, then upward within the second passageway and exits the cooking appliance through the at least one exit opening.

2. The cooking appliance according to claim 1, wherein the second passageway is defined between the main back panel and the rear wall of the oven cavity.

3. The cooking appliance according to claim 2, further comprising: a plurality of through openings formed in the main back panel for directing the flow of cooling air out of the second passageway, toward the back panel and out the at least one exit opening.

4. The cooking appliance according to claim 3, wherein the plurality of through openings include at least first and second vertically spaced sets of through openings.

5. The cooking appliance according to claim 4, wherein the second set of through openings is defined by apertures formed in the main back panel for terminal connectors of an electric heating element for the oven cavity.

6. The cooking appliance according to claim 5, wherein first and second oven cavities are arranged within the cabinet, with the second passageway extending adjacent a rear wall of each of the first and second oven cavities.

7. The cooking appliance according to claim 6, wherein the cooking appliance defines a range including an upper cooking surface.

8. The cooking appliance according to claim 1, wherein first and second oven cavities are arranged within the cabinet, with the second passageway extending adjacent a rear wall of each of the first and second oven cavities.

9. The cooking appliance according to claim 8, wherein the cooking appliance defines a range including an upper cooking surface.

10. A cooking appliance comprising:

a cabinet including at least a front portion, opposing side panels, a bottom panel and a back panel, said cabinet being adapted to rest upon a supporting surface with the bottom panel being spaced above the supporting surface so as to define a first passageway beneath the cabinet;

at least one oven cavity positioned within the cabinet, said oven cavity including a rear wall spaced from the back panel such that a second passageway, which is open to the first passageway, extends upward between the rear wall of the oven cavity and the back panel;

at least one exit opening formed in an upper portion of the back panel, wherein cooling air is caused to flow, during operation of the cooking appliance, from the front portion toward the back panel through the first passageway, then upward within the second passageway and exits the cooking appliance through the at least one exit opening;

a power cord including a plurality of wires attached to and extending behind the cabinet; and a lower vertical extension member for preventing the power cord from projecting into the first passageway beneath the cabinet.

11. The cooking appliance according to claim 10, wherein the extension member includes a plurality of slots for fluidly interconnecting the first and second passageways.

12. The cooking appliance according to claim 1, wherein the main back panel includes spaced, rearwardly projecting side wall portions and a plurality of vertically arranged air flow holes formed in the side wall portions of the main back panel, with the air flow holes interconnecting the first and second passageways.

13. A cooking appliance comprising:

a cabinet having front and rear portions;

an upper cooking surface;

a first oven cavity located within said cabinet, said first oven cavity having a rear wall;

a second oven cavity located within said cabinet, said second oven cavity having a rear wall;

a plurality of leg members positioned to lift said cabinet away from a supporting surface so as to define a first passageway beneath the cabinet through which air may flow from said front portion to said rear portion;

a first opening formed in said cabinet at a lower rear location, said first opening being in fluid communication with the first passageway such that air flowing through the first passageway can enter the cabinet through the first opening;

a second opening formed at a high location in said rear portion; and a second passageway extending adjacent the rear wall of each of said first and second oven cavities and fluidly interconnecting said first and second openings wherein, during operation of the cooking appliance, cooling air is caused to travel beneath the cabinet within said first passageway to said rear portion, enter said first opening in said cabinet, flow up through said second passageway, and exit through said second opening.

14. The cooking appliance according to claim 13, wherein said cabinet includes side panels, a back panel, and a main back panel extending between the side panels at a position located between the rear wall of the oven cavity and the back panel.

15. The cooking appliance according to claim 14, wherein the second passageway is defined between the main back panel and the rear wall of the oven cavity.

16. The cooking appliance according to claim 15, further comprising: a plurality of through openings formed in the main back panel for directing the flow of cooling air out of the second passageway, toward the back panel and out the second opening.

17. The cooking appliance according to claim 16, wherein the plurality of through openings include at least first and second vertically spaced sets of openings.

18. The cooking appliance according to claim 17, wherein the second set of through openings is defined by apertures formed in the main back panel for terminal connectors of an electric heating element for the oven cavity.

19. The cooking appliance according to claim 18, further comprising: a second oven cavity arranged within the cabinet, with the second passageway extending adjacent each of the oven cavities.

20. The cooking appliance according to claim 14, further comprising:

a power cord including a plurality of wires attached to one of the back panel and the main back panel; and a lower vertical extension member for preventing the power cord from projecting into the first passageway beneath the cabinet.

21. The cooking appliance according to claim 20, wherein the extension member includes a plurality of slots for fluidly interconnecting the first and second passageways.

22. The cooking appliance according to claim 14, wherein the main back panel includes spaced, rearwardly projecting side wall portions and a plurality of vertically arranged air flow holes formed in the side wall portions of the main back panel, with the air flow holes interconnecting the first and second passageways.

23. A method of directing a flow of cooling air through a cooking appliance including a cabinet having at least one oven cavity arranged between front, rear, side and bottom panel portions of the cabinet comprising:

causing cooling air to flow beneath the bottom panel portion of the cabinet, from adjacent the front panel portion, toward the rear panel portion;

directing the cooling air to flow into a lower rear portion of the cabinet;

guiding the cooling air to flow vertically within a passageway defined between a rear wall of the oven cavity and the rear panel portion of the cabinet;

enabling the cooling air to exit the cabinet at an upper rear portion of the cabinet;

drawing the cooling air into the passageway through openings formed in a main back panel positioned between the rear wall of the oven cavity and the rear panel portion of the cabinet;

permitting the cooling air to flow into another passageway located between the main back panel and the rear panel; and enabling the cooling air to exit the cabinet through openings provided in the rear panel.

24. The method according to claim 23, further comprising: attaching an electrical power cord to the cooking appliance at a lower section of the main back panel.

25. A method of directing a flow of cooling air through a cooking appliance including a cabinet having at least one oven cavity arranged between front, rear, side and bottom panel portions of the cabinet comprising:

causing cooling air to flow beneath the bottom panel portion of the cabinet, from adjacent the front panel portion, toward the rear panel portion;

directing the cooling air to flow into a lower rear portion of the cabinet;

guiding the cooling air to flow vertically within a passageway defined between a rear wall of the oven cavity and the rear panel portion of the cabinet;

enabling the cooling air to exit the cabinet at an upper rear portion of the cabinet;

attaching an electrical power cord to the cooking appliance, with the power cord extending behind the cabinet; and providing a vertical extension piece, which projects vertically below the bottom panel portion, at a rear section of the cabinet in order to prevent the power cord from becoming lodged beneath the bottom panel.

* * * * *